US005546680A

United States Patent [19]

Barma et al.

[11] Patent Number: 5,546,680

[45] Date of Patent: Aug. 20, 1996

[54] SAFETY FOOTWEAR

[75] Inventors: Tarachand S. Barma; John L. Baier, both of La Crosse, Wis.

[73] Assignee: LaCrosse Footwear, Inc., LaCrosse, Wis.

[21] Appl. No.: 122,617

[22] Filed: Sep. 17, 1993

Related U.S. Application Data

[63] Continuation of Ser. No. 967,770, Oct. 28, 1992, abandoned.

[51] Int. Cl.[6] ..... A43B 13/16

[52] U.S. Cl. ..... 36/108; 36/72 A; 36/73; 36/4

[58] Field of Search ..... 36/107, 108, 72 R, 36/152, 167, 4, 171, 72 A, 175, 73, 177

[56] References Cited

U.S. PATENT DOCUMENTS

| | | | |
|---|---|---|---|
| 1,153,441 | 9/1915 | Piessens | 36/171 |
| 1,447,463 | 3/1923 | Cooper | 36/171 |
| 1,507,928 | 9/1924 | Morton | 36/167 |
| 1,709,183 | 4/1929 | Mirizo | 36/175 |
| 1,849,630 | 3/1932 | MacDonald | 36/167 |
| 2,060,391 | 11/1936 | Castagnola | 36/167 |
| 2,112,296 | 3/1938 | Marcus | 36/171 |
| 2,114,505 | 4/1938 | Scholl | 36/171 |
| 2,134,221 | 10/1938 | Walker | 36/171 |
| 2,142,839 | 1/1939 | Flint | 36/171 |
| 2,147,913 | 2/1939 | Moore | 36/171 |
| 2,229,387 | 1/1941 | Parker | 36/72 R X |
| 2,696,682 | 12/1954 | Bettman et al. | 36/171 |
| 2,713,732 | 7/1955 | Guest | 36/167 |
| 3,028,689 | 4/1962 | Dassler | 36/72 R X |
| 4,102,062 | 7/1978 | Adams | 36/72 R |
| 4,166,328 | 9/1979 | Hamilton | 36/72 R |
| 4,257,177 | 3/1981 | Unsted | 36/72 R X |
| 4,574,497 | 3/1986 | Jindra | 36/107 X |
| 4,703,533 | 11/1987 | Barma . | |
| 4,858,337 | 8/1989 | Barma . | |
| 4,897,939 | 2/1990 | Harrington | 36/107 X |
| 4,908,963 | 3/1990 | Krajcir et al. | 36/72 R X |

FOREIGN PATENT DOCUMENTS

| | | |
|---|---|---|
| 0642743 | 2/1937 | Germany . |
| 2655384 | 6/1977 | Germany . |

OTHER PUBLICATIONS

UK Patent Application GB 2055549A Mar. 1981.

*Primary Examiner*—Ted Kavanugh
*Attorney, Agent, or Firm*—Foley & Lardner

[57] ABSTRACT

A footwear product, such as a rubber boot, has protective plates disposed to prevent the penetration of sharp objects into a wearer's foot. A first rigid protective plate is embedded in the sole, and a second rigid protective plate is disposed to cover an inside side portion of the instep. In combination, the plates prevent penetration of a sharp object into the wearer's foot when the wearer steps on the object.

16 Claims, 2 Drawing Sheets

SAFETY FOOTWEAR

This is a continuation of application Ser. No. 07/967,770 filed Oct. 28, 1992 abandoned.

TECHNICAL FIELD

This invention generally relates to footwear products and the manufacture thereof. More particularly, this invention relates to the manufacture of safety footwear, particularly rubber boots equipped with rigid protective inserts.

BACKGROUND OF THE INVENTION

The need for rigid protective inserts in footwear products has long been recognized. Footwear products, particularly rubber boots, are often used in hazardous environments where sharp objects can puncture the footwear product and injure the wearer. For example, firemen wear rubber boots on the job. Sharp objects, such as upturned nails protruding from boards on the ground or floor, can puncture the boot and cause injury unless a rigid protective insert are used to prevent penetration of the sharp object. For this purpose, currently available fireman's safety boots contain a metal midsole insert having the same shape as the sole of the foot.

Various other protective inserts are used in footwear products both to protect the wearer from injury and provide rigidity to the footwear product. Rubber footwear products, for example, have incorporated a heel support or heel counter which is embedded within the footwear product as described in commonly-assigned U.S. patent application Ser. No. 07/495,021. A rigid safety toe cap, likewise embedded within the layers of the boot, protects the wearer's toes.

As described in the above-cited U.S. patent application, rubber footwear products are conventionally made from uncured rubber or rubber-coated fabrics that are cut to a desired size for a specific part of the footwear product and then assembled on a forming device, such as a metal last. The uncured rubber assembly is vulcanized for about one to two hours at temperatures ranging from about 200 to 400 degrees fahrenheit. This vulcanization chemically and physically melds the component parts by cross-linking the uncured rubber into a complete vulcanizate footwear product so that the resulting footwear product has a unitary construction. Cross-linking occurs both within the individual assembled component parts and between each part. Throughout this application, this melding of component parts will be referred to as "intervulcanization". Multilayer rubber boots of this type are generally described in Barma U.S. Pat. Nos. 4,703,533 and 4,858,337.

This conventional formation of rubber footwear products, relying on intervulcanization of the component parts, places severe constraints on the type of rubber footwear which can be produced. Conventional rubber footwear is flexible and does not provide rigid support or protection common in other kinds of footwear. However, the vulcanization process provides a product resistant to air, gas, sunlight, hydrocarbons, moisture penetration, fats and oils, acid and other chemicals, as well as providing a product having excellent durability, wear, and strength. It is desirable to maintain these attributes while providing a footwear product which protects the wearer from the penetration of sharp objects.

Known safety boot designs fail to recognize that placing a rigid steel plate in the sole of the boot does not completely protect the foot from sharp objects. An inside portion of the human instep near the sole remains unprotected by a midsole insert. The present invention provides more complete protection by providing a rubber footwear product with a rigid protective insert that protects the sole of the wearer's foot and also the inside or arched portion of the wearer's instep that is exposed to penetration by sharp objects from below.

SUMMARY OF THE INVENTION

The present invention provides a safety footwear product such as rubber boot wherein the sole and the downwardly-facing portion of the instep are each provided with a rigid protective plate. A safety footwear product according to the invention includes an upper portion and a lower portion integral with or secured to the upper portion. The lower portion includes a sole and an instep. The sole has a first rigid protective plate effective to prevent the penetration of a sharp object into a wearer's foot when a wearer wearing the footwear product steps on the object with the sole. Similarly, the instep has a second protective plate disposed to cover an inside side portion of the instep at a location to one side of the first protective plate in a manner effective to prevent penetration of a sharp object into the wearer's foot when the wearer steps on the object with the inside side portion of the instep. A "sharp object" for purposes of the invention is an upturned nail protruding from a board on the ground or floor, or any similar sharp object with comparable ability to cut into or puncture a conventional rubber boot.

In a preferred embodiment, a boot of the invention includes two separate rigid inserts, one for the sole and one for the instep as described above. The two inserts can be installed into a rubber footwear product such as a boot or shoe more readily than a unitary midsole plate having an upturned lateral flange for covering the instep.

BRIEF DESCRIPTION OF THE DRAWINGS

A preferred embodiment of the present invention will hereinafter be described in conjunction with the drawings, wherein like numerals denote like elements, and.

DETAILED DESCRIPTION OF THE PREFERRED EMBODIMENT

Figure 1:
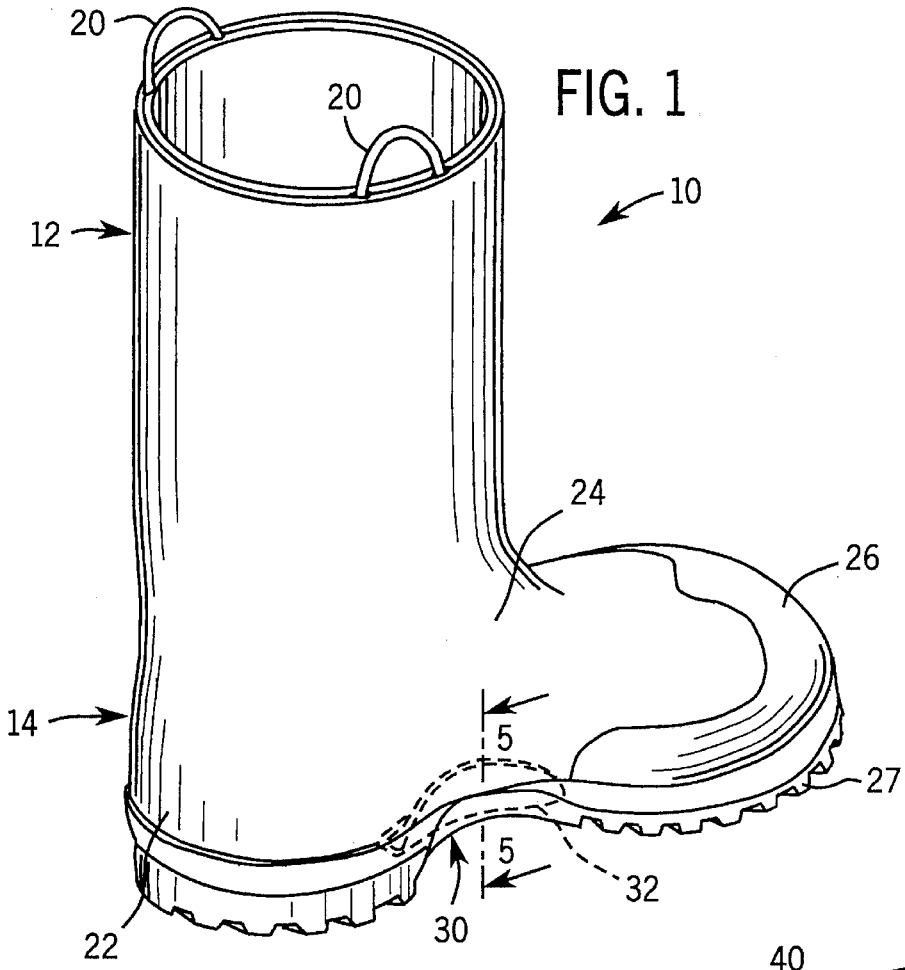
FIG. 1 is a perspective side view of a rubber boot of the invention.

With reference to FIG. 1, a footwear product in the form of a boot 10 in accordance with the present invention includes an upper-portion 12 and a lower portion 14. Upper portion 12 is of conventional design and includes a rubber outer layer and an inner fabric lining. A pair of pull-up straps 20 are attached along the top of upper portion 12 to facilitate pulling boot 10 over the foot and lower leg of the wearer. Lower portion 14 comprises a heel 22, an instep (central portion) 24, a toe 26, and a rubber outsole 27.

A protective plate 32 according to the invention is disposed to cover an inside side portion 30 of instep 24. Protective plate 32 is preferably embedded between the layers of lower portion 14, as described in detail below, and is illustrated in FIG. 1 by dashed lines. Plate 32 could, however, be mounted on the outside of boot 10. Plate 32 must be rigid enough and strong enough to stop a sharp object, such as a nail sticking up from a piece of wood, when the wearer of boot 10 steps on the object with inside side portion 30 of instep 24. Preferably, plate 32 is made from a metal such as steel, although it could also be made from a tough, rigid plastic such as vinyl (e.g., PVC), fiberglass, or graphite.

Figure 2:
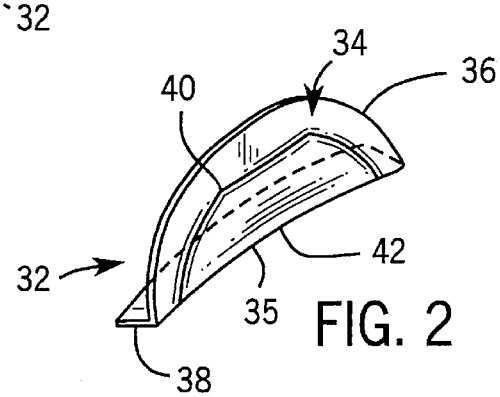
FIG. 2 is a perspective side view of the protective insert of the invention shown in FIG. 1.
Figure 3:
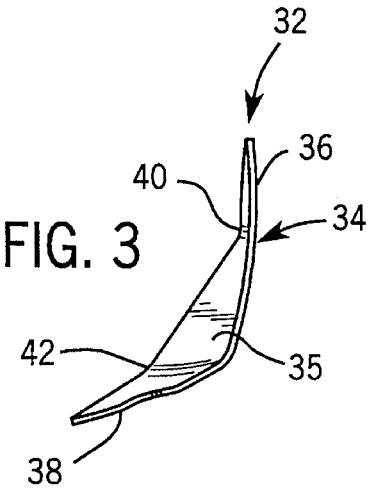
FIG. 3 is an end view of the protective insert shown in FIG. 2.
Figure 4:
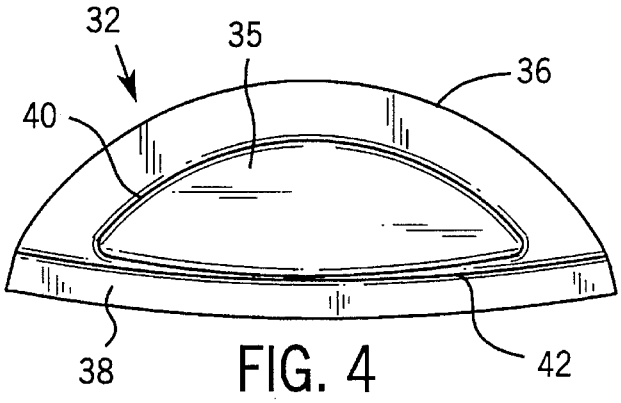
FIG. 4 is a side elevational view of the protective insert shown in FIG. 2.

Referring to FIGS. 2 to 4, protective plate 32 generally conforms in shape to inside side portion 30, in other words, the portion of the side of the foot that extends laterally beyond the sole and is vulnerable to injury by penetration from below. This inside side portion of the instep is on the right side of a footwear product for a left foot as shown in FIG. 1, and on the left side of a footwear product for a right foot. Accordingly, protective plate 32 includes a concave shell 34 configured to fit into the arched midportion of the inside of lower portion 14, as shown. As to vertical configuration, shell 34 extends upwardly and outwardly from a bottom edge thereof (see FIG. 3), and as to horizontal (lengthwise) configuration, shell 34 has a center portion 35 that extends laterally inwardly towards the center of the footwear product from its front and rear ends. In particular, concave shell 34 has an outwardly opening concave center portion 35 and a semicircular upper edge 36 which, when embedded in boot 10, extends generally towards upper portion 12 of the boot. Plate 32 also includes a laterally extending bottom flange 38 that extends from shell 34 inwardly towards the center of boot 10. The front and rear ends of concave portion 35 are disposed further laterally outwardly from the center of the footwear product than a midpoint of concave portion 35.

Semicircular upper edge 36 meets concave center portion 35 along a curved line 40. Similarly, laterally extending bottom flange 38 is bent inwardly from concave center portion 35 along a second curved line 42 that curves in a direction approximately perpendicular to the direction of curvature of line 40. Flange 38 also extends at an obtuse angle relative to upper edge 36 and curves in the same direction as concave center 35 (see FIG. 3).

Figure 5:
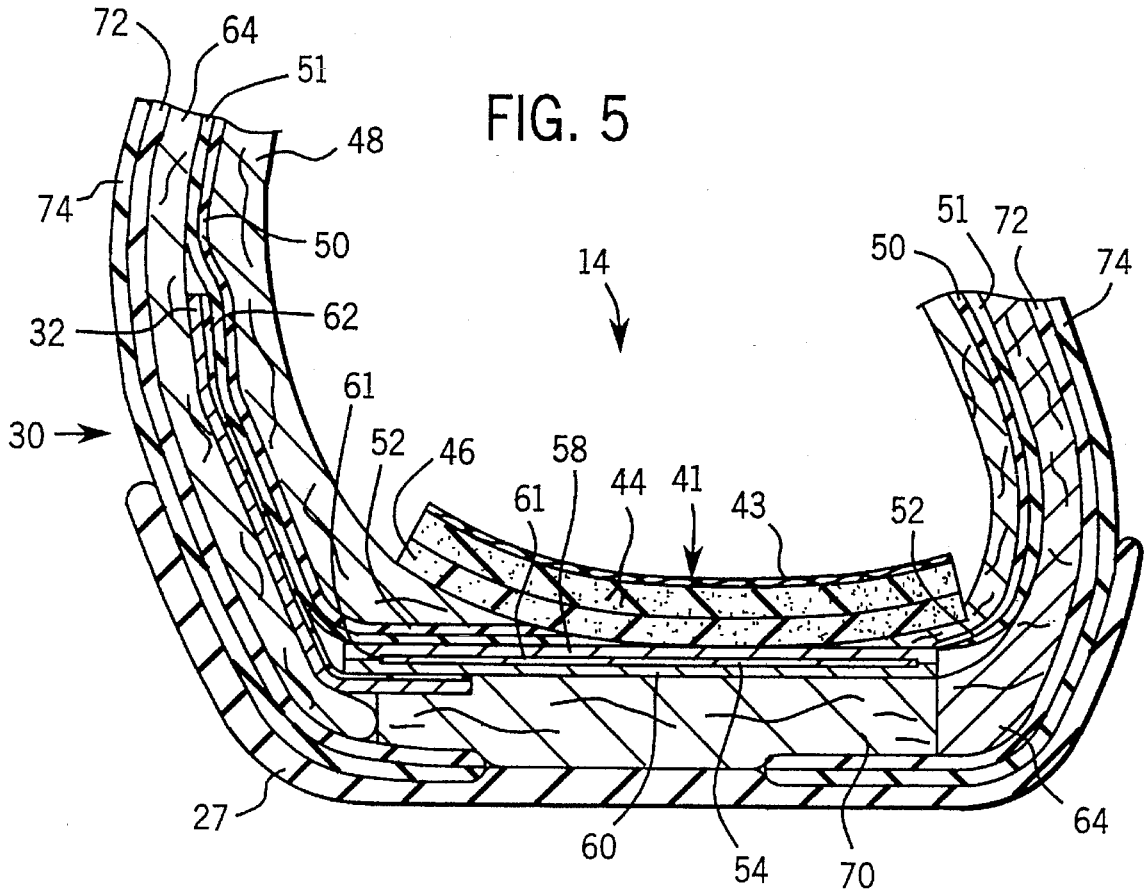
FIG. 5 is a cross-sectional view taken along the line 5—5 in FIG. 1.

Referring to FIG. 5, lower portion 14 is made of a plurality of vulcanizable rubber layers and other conventional components. A foot-shaped inner sole liner 41 includes a fabric covering 43, a foam rubber liner pad 44 and a rubberized fabric layer 46. A partial, coarse, fiber lining 48 having an outside backing made of rubber extends along the top and sides of lower portion 14 rearwardly of toe 26, and has its ends inserted beneath sole liner 41. A pair of rubber-backed fabric layers 50, 51, each mounted rubber side out, extend along the outside of fiber lining 48 and continue forward over the toe. Rubber layers 50, 51 similarly have a pair of lower end portions 52 which extend beneath the midsole as described below.

A rigid protective midsole plate 54 underlies liner 41 and end portions 52. Plate 54 spans the entire width and length of the part of outsole 27 that contacts the ground and is sheathed by a pair of rubberized fabric layers 58, 60. Plate 54 is preferably made of steel, but could also be made of other materials as described above for plate 32.

Protective plate 32 is disposed to one side of protective plate 54 in a manner effective to prevent penetration of a sharp object to the wearer's foot when the wearer steps on the sharp object with the inside side portion 30 of instep 24. The laterally extending bottom flange 38 of protective plate 32 preferably overlaps rigid protective plate 54 along at least an edge portion 61 of the middle of protective plate 54. In the preferred embodiment, bottom flange 38 underlies rigid protective plate 54 and bottom rubberized fabric layer 60 so that bottom layer 60 separates plates 54 and 32. The remainder of protective plate 32, including concave center region 35 and semicircular upper edge 36, extend generally upwardly along inside portion 30 on the outside of rubber-lined fabric layer 51.

Protective plates 54 and 32 could be made as a single integral component, but it is preferred that they be separate pieces. This allows the same sized instep protective plate 32 to be used with several different sizes of boot 10. For example, in the illustrated embodiment, three sizes of plates 32 can be used to make boots of men's sizes 2 to 15. If plate 32 is fashioned as a tab extending from sole plate 54, a different plate would be needed for each size.

A foam pad 62, shaped generally like protective plate 32 but slightly larger in length and width, is interposed between plate 32 and layers 51, 60. Foam pad 62 is made of a rubber that foams during vulcanization and bonds (intervulcanizes) plate 32 to layers 51, 60, thereby providing an adhesive layer that holds plate 32 in the correct position relative to the underlying and overlying layers of boot 10. In the alternative, other forms of adhesives useful in rubber footwear can be used to secure plate 32 to layers 51, 60.

A lining of conventional foam padding 64 overlies the outside of plate 32 and extends along the top and sides of lower portion 14. The bottom ends of foam padding 64 adjoin a thick, coarse fiber midsole 70 disposed directly beneath layer 60. A double layer 72, 74 each made of rubber-backed fabric (rubber side out) forms the exterior of lower portion 14, and may optionally continue upwardly in a tubular configuration to form upper portion 12, covering the leg and ankle. In the alternative, a leather upper may be used that is sewn to lower portion 14, in a manner well known in the art. The lower ends of rubber outer layers 72, 74 are tucked beneath midsole 70 as shown. Rubber outsole 27 is applied over layers 72, 74 and midsole 70 to complete boot 10.

In manufacturing the fireman's boot shown in the drawings, the interior layers are applied to the last first and additional layers are progressively overlaid until all components are in place. The uncured assembly is then vulcanized to produce a unitary rubber boot. Boot 10 preferably also contains a conventional steel safety toe cap (not shown) that may be disposed at any convenient location inside of outer rubber-lined fabric layers 72, 74 and outside of rubber-lined fabric layers 50, 51. A rigid heel counter, such as the one disclosed in the above-cited U.S. patent application, can be incorporated into heel 22.

It will be understood that the above description is of a preferred exemplary embodiment of the present invention, and that the invention is not limited to the specific forms shown. For example, rigid protective plate 32 may also be disposed so that laterally extending bottom flange 38 is spaced from rigid protective plate 54 by several intervening layers. Additionally, various layers of the footwear product can be added, rearranged, or omitted; the position of the protective plates within the thickness of the lower portion of the footwear product is not critical, but it is preferred for purposes of comfort, appearance and strength to embed and secure each plate within the layers of the lower portion rather than have the plates exposed on the inside or outside. Other substitutions, modifications, changes, and omissions may also be made in the design and arrangement of the elements without departing from the spirit of the invention as expressed in the appended claims.

We claim:

1. A footwear product, comprising:

an upper portion configured for covering a human foot; and a lower portion secured to the upper portion, said lower portion including:

a sole having a first protective plate spanning substantially the entire length and width of the part of the sole that underlies the wearer's foot when the footwear product is worn and effective to prevent penetration of a sharp object to a wearer's foot when a wearer wearing the footwear product steps on the sharp object with the sole, and further including an instep having a second protective plate disposed to cover an inside side portion of the instep, which inside side portion of the instep is on the right side of a footwear product for a left foot and is on the left side of a footwear product for a right foot, at a location to one side of the first protective plate in a manner effective to prevent penetration of a sharp object to the wearer's foot when the wearer steps on the sharp object with the inside side portion of the instep, which second protective plate conforms in shape to the inside side portion of the instep and comprises a shell that, as to vertical configuration, extends upwardly and outwardly from a bottom edge thereof, and as to horizontal configuration, has a center portion which extends laterally inwardly from its front and rear ends and wherein the first protective plate is separate from the second protective plate.

2. The footwear product of claim 1, wherein the first and second protective plates are embedded within the lower portion of the footwear product.

3. The footwear product of claim 1, wherein the first protective plate is spaced from the second protective plate by at least one intervening layer of the lower portion.

4. The rubber boot of claim 3, wherein the first and second protective plates are made of rigid metal.

5. The footwear product of claim 3, wherein the first and second protective plates are embedded within the lower portion of the footwear product.

6. The footwear product of claim 5, wherein the second protective plate comprises a concave shell having a generally semi-circular upper edge and an inwardly extending lateral bottom flange that overlaps the first protective plate.

7. The footwear product of claim 6, further comprising an adhesive layer that bonds the second protective plate to an adjoining layer of the lower portion.

8. The footwear product of claim 1, wherein the second protective plate comprises a concave shell having a generally semi-circular upper edge and an inwardly extending lateral bottom flange that overlaps the first protective plate.

9. The footwear product of claim 1, further comprising an adhesive layer that bonds the second protective plate to an adjoining layer of the lower portion.

10. The footwear product of claim 1, wherein the first and second protective plates are made of metal.

11. The footwear product of claim 1, wherein the center portion of the second protective plate has an outwardly-opening concave shape, and the second protective plate has an upper edge which extends generally towards the upper portion of the footwear product and has a laterally extending bottom flange that extends inwardly;

wherein the concave center portion extends upwardly and outwardly from the bottom flange so that the bottom flange extends at an obtuse angle relative to the upper edge of the second protective plate, and wherein the concave center portion curves inwardly in the lengthwise direction of the footwear product so that front and rear ends of the concave center portion are disposed further laterally outwardly than a midpoint of the concave center portion.

12. A rubber safety boot, comprising:

an upper portion configured for covering a human foot and lower leg, including an outer rubber layer; and a lower portion secured to the upper portion including a heel, an instep, and a toe each having an outer rubber layer, and a sole including:

a rubber outsole, a midsole comprising a first protective plate spanning substantially the entire length and width of the part of the outsole that underlies the wearer's foot when the footwear product is worn and effective to prevent penetration of a sharp object to a wearer's foot when a wearer steps on the sharp object with the outsole, and a sole liner overlying the midsole;

and wherein the instep has a second protective plate disposed to cover an inside side portion of the instep, which inside side portion of the instep is on the right side of a footwear product for a left foot and is on the left side of a footwear product for a right foot, at a location to one side of the first protective plate in a manner effective to prevent penetration of a sharp object to the wearer's foot when the wearer steps on the sharp object with the inside side portion of the instep, which second protective plate conforms in shape to the inside side portion of the instep and comprises a shell that, as to vertical configuration, extends upwardly and outwardly from a bottom edge thereof, and as to horizontal configuration, has a center portion which extends laterally inwardly from its front and rear ends and wherein the first protective plate is separate from the second protective plate.

13. The rubber boot of claim 12, wherein the second protective plate comprises a concave shell having a generally semi-circular upper edge and an inwardly extending lateral bottom flange that overlaps the first protective plate, and is spaced from the first protective plate by at least one intervening layer of the sole.

14. The rubber boot of claim 13, further comprising an adhesive layer that bonds the second protective plate to an adjoining layer of the instep.

15. The rubber boot of claim 14, wherein the first and second protective plates are made of a rigid metal.

16. A rubber safety boot, comprising:

an upper portion configured for covering a human foot and lower leg, including an outer rubber layer; and a lower portion secured to the upper portion including a heel, an instep, and a toe each having an outer rubber layer, and a sole including:

a rubber outsole, a midsole comprising a first protective plate spanning substantially the entire length and width of the part of the outsole that underlies the wearer's foot when the footwear product is worn and effective to prevent penetration of a sharp object to a wearer's foot when a wearer steps on the sharp object with the outsole, and a sole liner overlying the midsole;

and wherein the instep has a second protective plate disposed to cover an inside side portion of the instep, which inside side portion of the instep is on the right side of a footwear product for a left foot and is on the left side of a footwear product for a right foot, at a location to one side of the first protective plate in a manner effective to prevent penetration of a sharp object to the wearer's foot when the wearer steps on the sharp object with the inside side portion of the instep, which second protective plate conforms in shape to the inside side portion of the instep and comprises a shell that, as to vertical configuration, extends upwardly and outwardly from a bottom edge thereof, and as to horizontal configuration, has a center portion which extends laterally inwardly from its front and rear ends, wherein the center portion of the second protective plate has an outwardly-opening concave shape, and the second protective plate has an upper edge which extends generally towards the upper portion of the boot and has a laterally extending bottom flange that extends inwardly;

wherein the concave center portion extends upwardly and outwardly from the bottom flange so that the bottom flange extends at an obtuse angle relative to the upper edge of the second protective plate, and wherein the concave center portion curves inwardly in the lengthwise direction of the boot so that front and rear ends of the concave center portion are disposed further laterally outwardly than a midpoint of the concave center portion.

* * * * *